US007557772B2

(12) United States Patent
De Flaviis et al.

(10) Patent No.: US 7,557,772 B2
(45) Date of Patent: Jul. 7, 2009

(54) PLANER HELICAL ANTENNA

(75) Inventors: Franco De Flaviis, Irvine, CA (US); Seunghwan Yoon, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 444 days.

(21) Appl. No.: 11/386,247

(22) Filed: Mar. 21, 2006

(65) Prior Publication Data

US 2007/0222700 A1 Sep. 27, 2007

(51) Int. Cl.
*H01Q 1/36* (2006.01)

(52) U.S. Cl. ..... 343/895; 343/700 MS; 340/10.1

(58) Field of Classification Search ..... 343/895, 343/702, 700 MS, 846; 375/361; 455/41.1; 340/10.1

See application file for complete search history.

(56) References Cited

U.S. PATENT DOCUMENTS 6,825,819 B2 * 11/2004 Kim et al. ..... 343/895
7,277,055 B2 * 10/2007 Tamaoka ..... 343/700 MS
2002/0118134 A1 * 8/2002 Chen ..... 343/700 MS
2003/0080904 A1 * 5/2003 Chen ..... 343/700 MS
2003/0179152 A1 * 9/2003 Watada et al. ..... 343/895
2003/0227411 A1 * 12/2003 Kim et al. ..... 343/702
2007/0172007 A1 * 7/2007 Shoarinejad et al. ..... 375/361

* cited by examiner

*Primary Examiner*—HoangAnh T Le
(74) *Attorney, Agent, or Firm*—Garlick Harrison & Markison; Timothy W. Markison

(57) ABSTRACT

An antenna includes a substantially planer substrate and a helical winding. The substantially planer substrate includes a first surface and a second surface. The helical winding includes a first pattern, a second pattern, and a plurality of interconnections. The first pattern is affixed to the first surface and the second pattern is affixed to the second surface. Connection nodes of the first pattern are coupled to associated connection nodes of the second pattern by the plurality of interconnections.

14 Claims, 6 Drawing Sheets

PLANER HELICAL ANTENNA

CROSS REFERENCE TO RELATED PATENTS

NOT APPLICABLE

STATEMENT REGARDING FEDERALLY SPONSORED RESEARCH OR DEVELOPMENT

NOT APPLICABLE

INCORPORATION-BY-REFERENCE OF MATERIAL SUBMITTED ON A COMPACT DISC

NOT APPLICABLE

BACKGROUND OF THE INVENTION

1. Technical Field of the Invention

This invention relates generally to wireless communication systems and more particularly to antennas used within wireless communication systems.

2. Description of Related Art

Communication systems are known to support wireless and wire lined communications between wireless and/or wire lined communication devices. Such communication systems range from national and/or international cellular telephone systems to the Internet to point-to-point in-home wireless networks to radio frequency identification (RFID) systems. Each type of communication system is constructed, and hence operates, in accordance with one or more communication standards. For instance, wireless communication systems may operate in accordance with one or more standards including, but not limited to, RFID, IEEE 802.11, Bluetooth, advanced mobile phone services (AMPS), digital AMPS, global system for mobile communications (GSM), code division multiple access (CDMA), local multi-point distribution systems (LMDS), multi-channel-multi-point distribution systems (MMDS), and/or variations thereof.

Depending on the type of wireless communication system, a wireless communication device, such as a cellular telephone, two-way radio, personal digital assistant (PDA), personal computer (PC), laptop computer, home entertainment equipment, RFID reader, RFID tag, et cetera communicates directly or indirectly with other wireless communication devices. For direct communications (also known as point-to-point communications), the participating wireless communication devices tune their receivers and transmitters to the same channel or channels (e.g., one of the plurality of radio frequency (RF) carriers of the wireless communication system) and communicate over that channel(s). For indirect wireless communications, each wireless communication device communicates directly with an associated base station (e.g., for cellular services) and/or an associated access point (e.g., for an in-home or in-building wireless network) via an assigned channel. To complete a communication connection between the wireless communication devices, the associated base stations and/or associated access points communicate with each other directly, via a system controller, via the public switch telephone network, via the Internet, and/or via some other wide area network.

For each wireless communication device to participate in wireless communications, it includes a built-in radio transceiver (i.e., receiver and transmitter) or is coupled to an associated radio transceiver (e.g., a station for in-home and/or in-building wireless communication networks, RF modem, etc.). As is known, the receiver is coupled to the antenna and includes a low noise amplifier, one or more intermediate frequency stages, a filtering stage, and a data recovery stage. The low noise amplifier receives inbound RF signals via the antenna and amplifies then. The one or more intermediate frequency stages mix the amplified RF signals with one or more local oscillations to convert the amplified RF signal into baseband signals or intermediate frequency (IF) signals. The filtering stage filters the baseband signals or the IF signals to attenuate unwanted out of band signals to produce filtered signals. The data recovery stage recovers raw data from the filtered signals in accordance with the particular wireless communication standard.

As is also known, the transmitter includes a data modulation stage, one or more intermediate frequency stages, and a power amplifier. The data modulation stage converts raw data into baseband signals in accordance with a particular wireless communication standard. The one or more intermediate frequency stages mix the baseband signals with one or more local oscillations to produce RF signals. The power amplifier amplifies the RF signals prior to transmission via an antenna.

Since the wireless part of a wireless communication begins and ends with the antenna, a properly designed antenna structure is an important component of wireless communication devices. As is known, the antenna structure is designed to have a desired impedance (e.g., 50 Ohms) at an operating frequency, a desired bandwidth centered at the desired operating frequency, and a desired length (e.g., ¼ wavelength of the operating frequency). As is further known, the antenna structure may include a single mono pole or dipole antenna, a diversity antenna structure, or any number of other electromagnetic properties. For instance, one popular antenna structure is a three-dimensional in-air helix antenna, which resembles an expanded spring. An in-air helix antenna provides a magnetic omni-directional mono pole antenna that is well suited for portable wireless communication devices. However, such an in-air helix antenna occupies a significant amount of space and the three dimensional aspects of it cannot be implemented on a planer substrate, such as a printed circuit board (PCB).

For PCB implemented antennas, the antenna has a meandering pattern on one surface of the PCB. Such an antenna consumes a relatively large area of the PCB. For example, for a ¼ wavelength antenna at 900 MHz, the total length of the antenna is approximately 8 centimeters (0.25 * 32 cm, which is the approximate wavelength of a 900 MHz signal). Even with a tight meandering pattern, the antenna consumes approximately 4 $cm^2$. With the never-ending push for smaller form factors with increased performance, a PCB meandering antenna is not acceptable for many newer wireless communication applications.

Therefore, a need exists for a small form factor antenna that offers the benefits of an in-air helix antenna and the convenience of PCB fabrication without the above mentioned limitations.

BRIEF SUMMARY OF THE INVENTION

The present invention is directed to apparatus and methods of operation that are further described in the following Brief Description of the Drawings, the Detailed Description of the Invention, and the claims. Other features and advantages of the present invention will become apparent from the following detailed description of the invention made with reference to the accompanying drawings.

BRIEF DESCRIPTION OF THE SEVERAL VIEWS OF THE DRAWING(S)

DETAILED DESCRIPTION OF THE INVENTION

Figure 1:
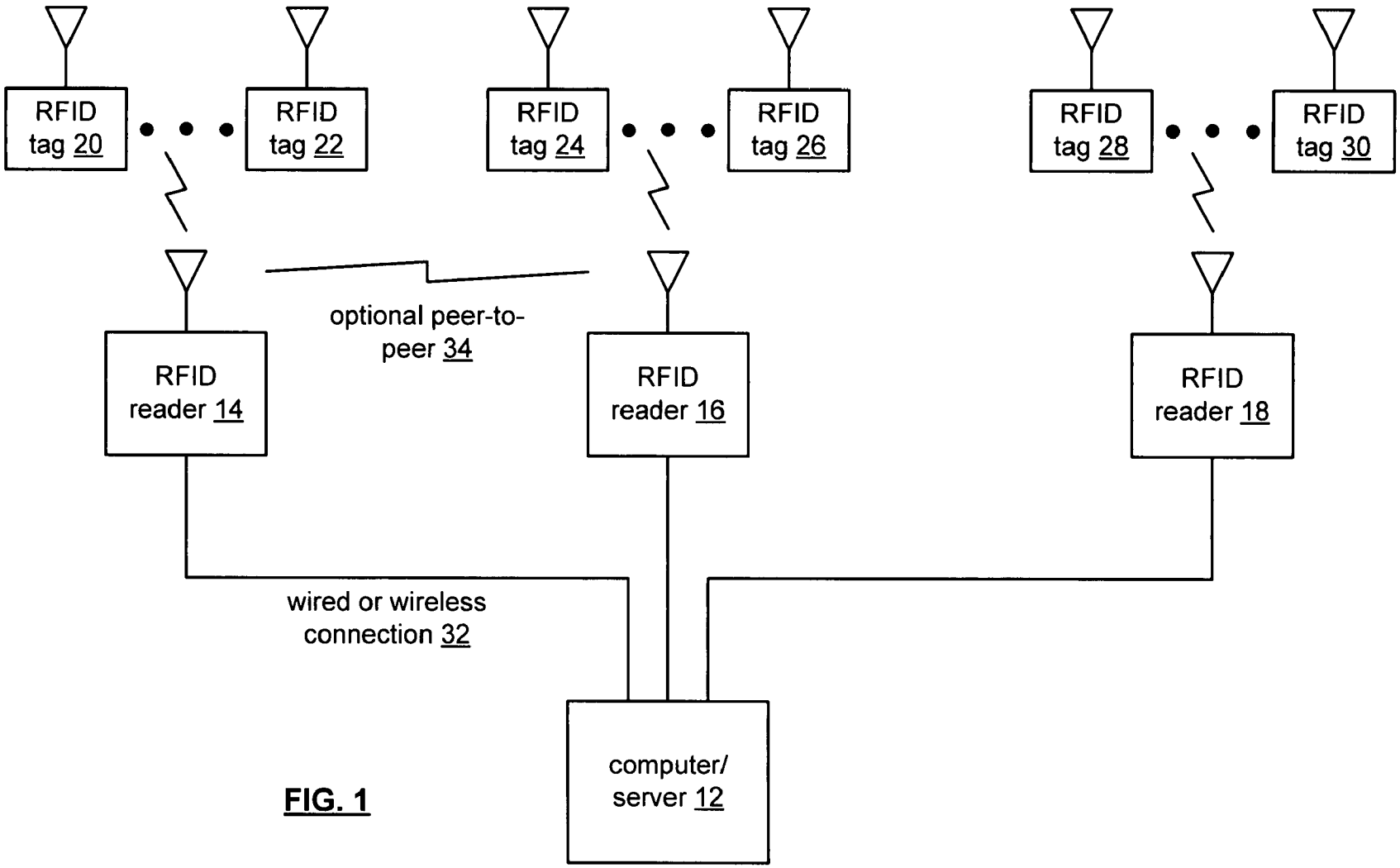
FIG. 1 is a schematic block diagram of an RFID system in accordance with the present invention.

FIG. 1 is a schematic block diagram of an RFID (radio frequency identification) system that includes a computer/server 12, a plurality of RFID readers 14-18 and a plurality of RFID tags 20-30. The RFID tags 20-30 may each be associated with a particular object for a variety of purposes including, but not limited to, tracking inventory, tracking status, location determination, assembly progress, et cetera.

Each RFID reader 14-18 wirelessly communicates with one or more RFID tags 20-30 within its coverage area. For example, RFID reader 14 may have RFID tags 20 and 22 within its coverage area, while RFID reader 16 has RFID tags 24 and 26, and RFID reader 18 has RFID tags 28 and 30 within its coverage area. The RF communication scheme between the RFID readers 14-18 and RFID tags 20-30 may be a back scatter technique whereby the RFID readers 14-18 provide energy to the RFID tags via an RF signal. The RFID tags derive power from the RF signal and respond on the same RF carrier frequency with the requested data.

In this manner, the RFID readers 14-18 collect data as may be requested from the computer/server 12 from each of the RFID tags 20-30 within its coverage area. The collected data is then conveyed to computer/server 12 via the wired or wireless connection 32 and/or via the peer-to-peer communication 34. In addition, and/or in the alternative, the computer/server 12 may provide data to one or more of the RFID tags 20-30 via the associated RFID reader 14-18. Such downloaded information is application dependent and may vary greatly. Upon receiving the downloaded data, the RFID tag would store the data in a non-volatile memory.

As indicated above, the RFID readers 14-18 may optionally communicate on a peer-to-peer basis such that each RFID reader does not need a separate wired or wireless connection 32 to the computer/server 12. For example, RFID reader 14 and RFID reader 16 may communicate on a peer-to-peer basis utilizing a back scatter technique, a wireless LAN technique, and/or any other wireless communication technique. In this instance, RFID reader 16 may not include a wired or wireless connection 32 computer/server 12. Communications between RFID reader 16 and computer/server 12 are conveyed through RFID reader 14 and the wired or wireless connection 32, which may be any one of a plurality of wired standards (e.g., Ethernet, fire wire, et cetera) and/or wireless communication standards (e.g., IEEE 802.11x, Bluetooth, et cetera).

As one of ordinary skill in the art will appreciate, the RFID system of FIG. 1 may be expanded to include a multitude of RFID readers 14-18 distributed throughout a desired location (for example, a building, office site, et cetera) where the RFID tags may be associated with equipment, inventory, personnel, et cetera. Note that the computer/server 12 may be coupled to another server and/or network connection to provide wide area network coverage. Further note that the carrier frequency of the wireless communication between the RFID readers 14-18 and RFID tags 20-30 may range from about 10 MHz to several gigahertz.

Figure 2:
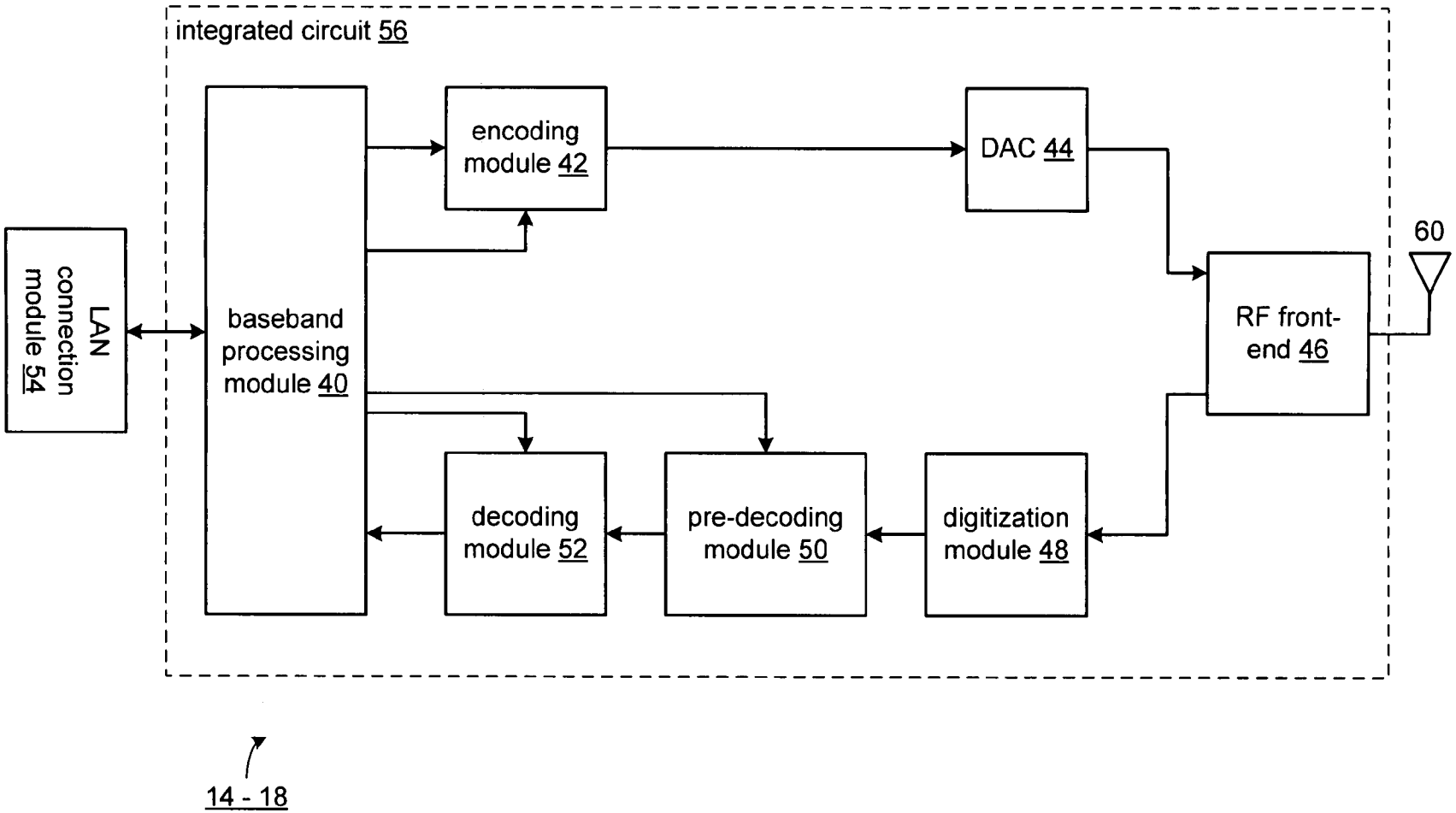
FIG. 2 is a schematic block diagram of an RFID reader in accordance with the present invention.

FIG. 2 is a schematic block diagram of an RFID reader 14-18 that includes an integrated circuit 56 and may further include a local area network (LAN) connection module 54. The integrated circuit 56 includes baseband processing module 40, an encoding module 42, a digital-to-analog converter (DAC) 44, an RF front-end 46, digitization module 48, predecoding module 50 and a decoding module 52. The local area network connection module 54 may include one or more of a wireless network interface (e.g., 802.11 n.x, Bluetooth, et cetera) and/or a wired communication interface (e.g., Ethernet, fire wire, et cetera).

The baseband processing module 40, the encoding module 42, the decoding module 52 and the pre-decoding module 50 may be a single processing device or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry and/or operational instructions. The one or more processing devices may have an associated memory element, which may be a single memory device, a plurality of memory devices, and/or embedded circuitry of the processing device. Such a memory device may be a read-only memory, random access memory, volatile memory, non-volatile memory, static memory, dynamic memory, flash memory, cache memory, and/or any device that stores digital information. Note that when the processing module 40, 42, 50, and/or 52 implements one or more of its functions via a state machine, analog circuitry, digital circuitry, and/or logic circuitry, the memory element storing the corresponding operational instructions may be embedded within, or external to, the circuitry comprising the state machine, analog circuitry, digital circuitry, and/or logic circuitry. Further note that, the memory element stores, and the processing module 40, 42, 50, and/or 52 executes, hard coded or operational instructions corresponding to at least some of the steps and/or functions illustrated in FIGS. 2-9.

In operation, the baseband processing module 40 prepares data for encoding via the encoding module 42, which may perform a data encoding in accordance with one or more RFID standardized protocols. The encoded data is provided to the digital-to-analog converter 44 which converts the digitally encoded data into an analog signal. The RF front-end 46 modulates the analog signal to produce an RF signal at a particular carrier frequency (e.g., 900 MHz) that is provided to the antenna 60, which will be described in greater detail with reference to FIG. 3-12.

The RF front-end 46 includes transmit blocking capabilities such that the energy of the transmit signal does not substantially interfere with the receiving of a back scattered RF signal received from one or more RFID tags. The RF front-end 46 converts the received RF signal into a baseband signal. The digitization module 48, which may be a limiting module or an analog-to-digital converter, converts the received baseband signal into a digital signal. The predecoding module 50 converts the digital signal into a biphase encoded signal in accordance with the particular RFID protocol being utilized. The biphase encoded data is provided to the decoding module 52, which recaptures data therefrom in accordance with the particular encoding scheme of the selected RFID protocol. The baseband processing module 40 provides the recovered data to the server and/or computer via the local area network connection module 54. As one of ordinary skill in the art will appreciate, the RFID protocols include one or more of line encoding schemes such as Manchester encoding, FM0 encoding, FM1 encoding, etc. As one of ordinary skill in the art will further appreciate, the antenna 60 has far more applications than RFID applications. For instance, the antenna 60 may be used in wireless local area network (WLAN) applications, cellular telephone applications, personal area networks (e.g., Bluetooth) applications, etc.

Figures 3, 4, 5, 6:
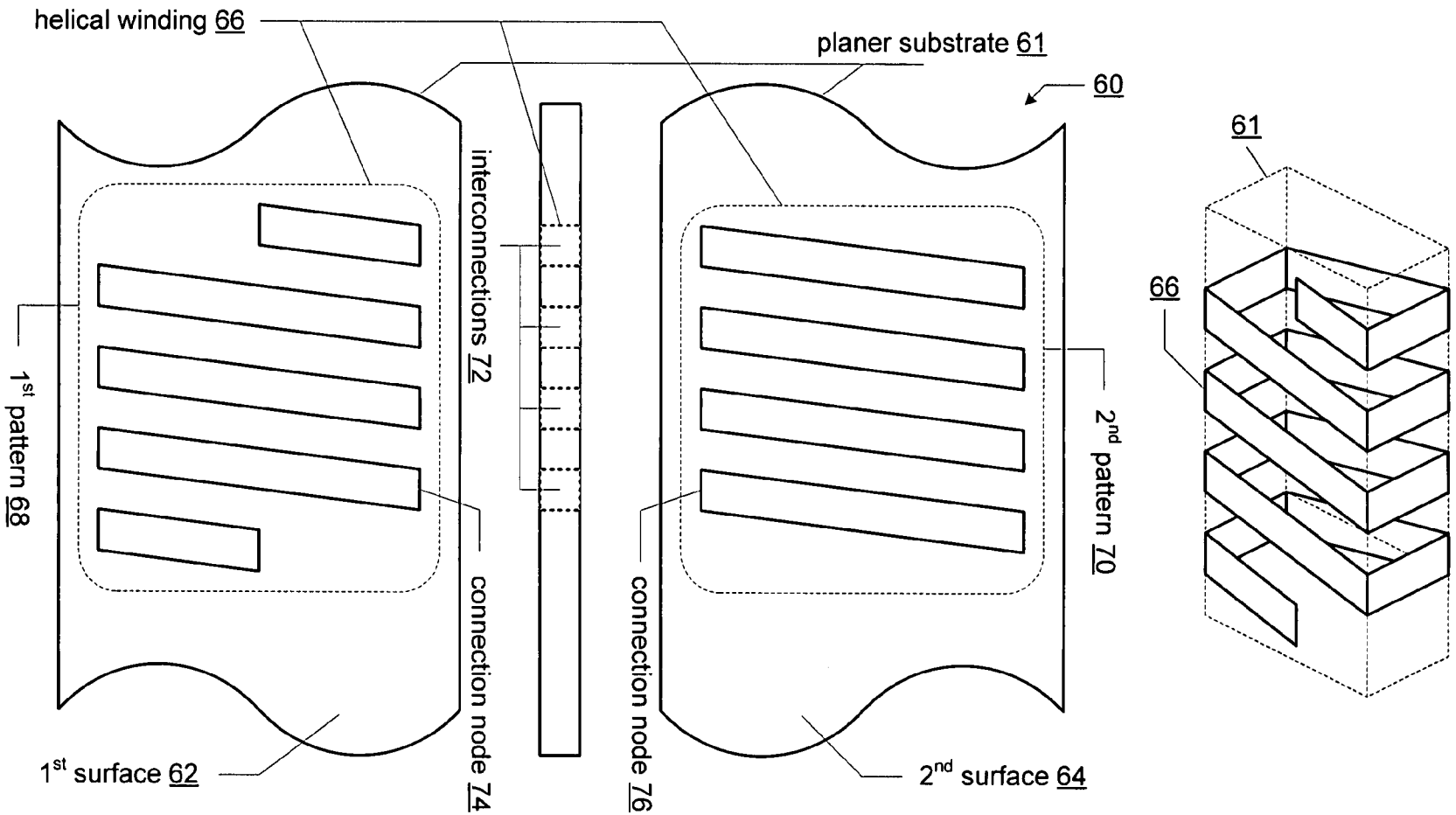
FIG. 3-6 are diagrams of an embodiment of an antenna in accordance with the present invention.

FIGS. 3-5 are a front, side, and bottom view, respectively, of an embodiment of an antenna 60 that includes a helical winding 66 on a planer substrate 61. The planer substrate 61, which may be a printed circuit board (PCB), an integrated circuit die, or other material that supports electronic circuitry, includes a first surface 62 and a second surface 64. The helical winding 66 includes a first pattern 68, a second pattern 70, and a plurality of interconnections 72. In this embodiment, the first pattern 68 is affixed (e.g., fabricated, printed, etched, deposited, etc.) on the first surface 62 and the second pattern is affixed on the second surface 64.

The first pattern 68 includes a plurality of substantially parallel traces (e.g., two or more), which may be metal traces on a PCB or integrated circuit die. The traces may be of the same length or different lengths and are angled with respect to their length axis. Note that if the traces are of the same length a periodic self resonance may develop, which is avoided by differing the lengths of the traces. Further note that if the traces are of different lengths, all of the traces may have different lengths or just adjacent traces may have different lengths. For example, if the first pattern includes six traces, the first, third, and fifth traces may be of the same length, and the second, fourth, and sixth traces may also be of the same length, but the length of the first, third, and fifth traces are different than the length of the second, fourth, and sixth traces.

The second pattern 70 includes a plurality of substantially parallel traces (e.g., two or more) that have connection nodes 76 of each trace aligned with connection nodes 74 of corresponding traces of the first pattern 68. The interconnections 72, which may be PCB or integrated circuit die vias or edge wrap-arounds, couple the connection nodes 74 of the first pattern 68 with the connection nodes 76 of the second pattern 70 to create a planer helical antenna. Note that the traces of the second pattern 70 may also have equal lengths or differing lengths and may be metal traces on a PCB or integrated circuit die. Further note that, while the traces of the first and second patterns are shown as straight lines, the traces may have different substantially parallel geometric shapes including, but not limited to, an arc, an "s" shape, or a "v" shape. Still further note that each of the plurality of traces of the first and second patterns includes a trace width and spacing from an adjacent trace based on PCB fabrication criteria (e.g., minimum spacing requirements, trace width for a certain frequency and/or current level) and wavelength of a signal being transceived by the antenna (e.g., impedance, capacitive coupling, magnetic coupling, etc).

FIG. 6 is an isometric view of the antenna 60 of FIGS. 3-5 that, because of the helical winding 66, provides a magnetic omni-directional mono-pole antenna that has a linear polarization (i.e., the electromagnetic field is in a single direction and does not change with time). The length of the helical winding 66 corresponds to a wavelength of an RF signal, a fraction of the wavelength of the RF signal, or a multiple of the wavelength of the RF signal. For example, the length of the helical winding 66 may be ¼ wavelength of an RF signal. As a specific example, for a 900 MHz RF signal, which has a wavelength of approximately 32 centimeters (cm), the length of the helical winding 66 is approximately 8 cm. The area allocated for the antenna 60 on the planer substrate 61 and the length of the helical winding 66 dictate the number and length of the traces in the first and second patterns. For example, if the area on the substrate is 1 cm by 1 cm, the thickness of the substrate 61 is 0.8 cm (e.g., thickness of an FR4 PCB), and the length of the helical winding is 8 cm, the number of traces in the first pattern 68 is 10 and is 9 for the second pattern 70.

Figures 7, 8, 9:
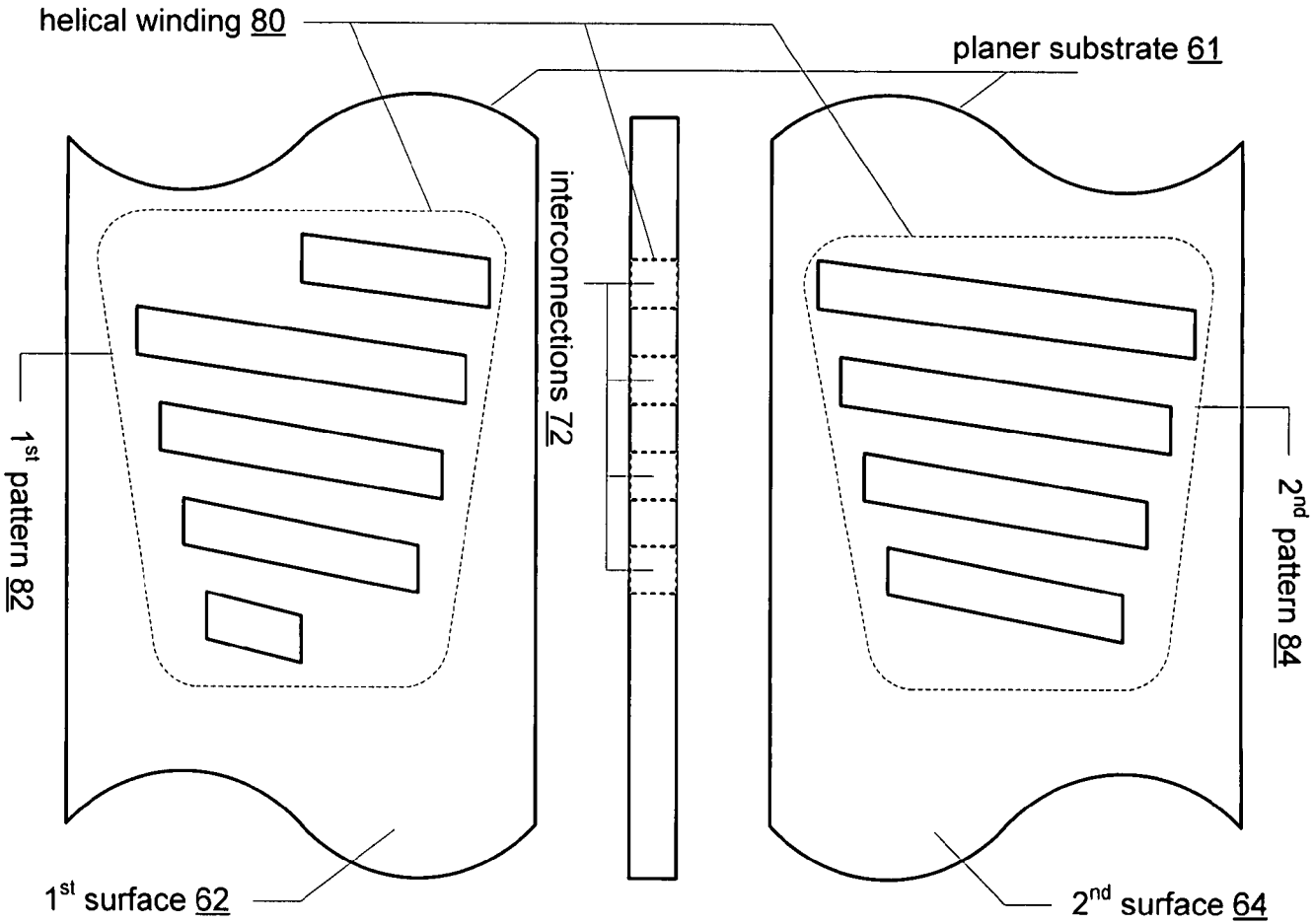
FIG. 7-9 are diagrams of another embodiment of an antenna in accordance with the present invention.

FIGS. 7-9 are a front, side, and bottom view, respectively, of an embodiment of an antenna 60 that includes a helical winding 80 on a planer substrate 61. The planer substrate 61 includes the first and second surfaces 62 and 64, which respectively support the first and second patterns 82 and 84 of the helical winding 80, respectively. In this embodiment, the first and second patterns 82 and 84 are tapered (i.e., the length of the traces of the pattern increase sequentially) and are connected by the interconnections 72. The tapering allows for a desired coupling between adjacent traces, impedance matching of the antenna 60, and substantially eliminates a periodic self resonance. The angle of the tapering is dependent upon the area of the substrate for the antenna, the desired impedance of the antenna, and the desired coupling between traces, but is at least a few degrees.

Figures 10, 11:
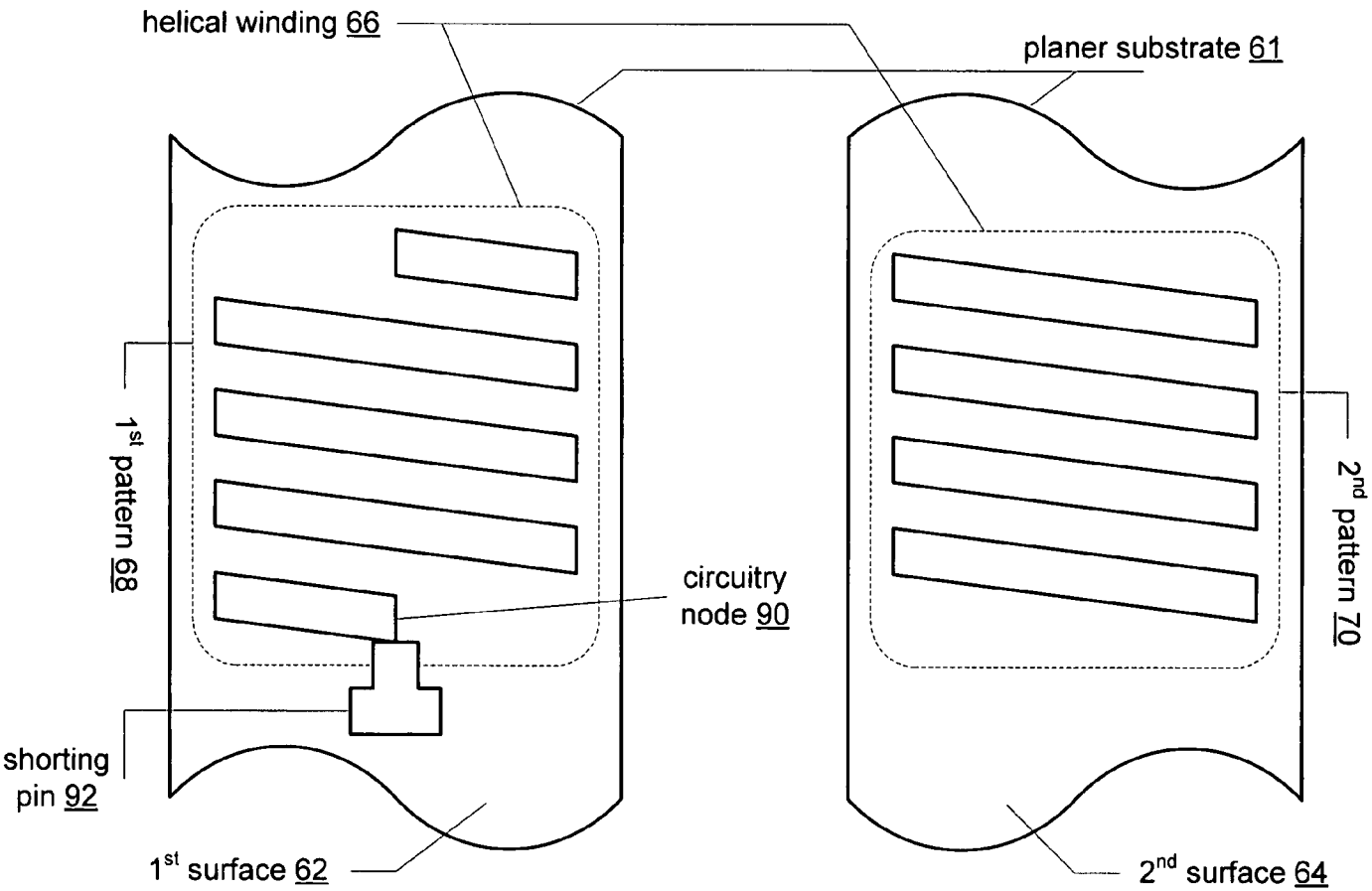
FIGS. 10 and 11 are diagrams of yet another embodiment of an antenna in accordance with the present invention.

FIGS. 10 and 11 are a front and bottom view, respectively, of another embodiment of an antenna 60 that includes the helical winding 66 and a shorting pin 92 on the planer substrate 61. The shorting pin 92 is a trace that is coupled to the helical winding 66 at a circuitry node 90, which may be any point on the first or second patterns 68 or 70, and to ground. In this illustration, the shorting pin 92 is coupled to a circuitry node 90 on the first pattern 68. The coupling of the shorting pin 92 to the circuitry node 90 tunes the frequency response of the antenna 60 and/or adjusts the impedance of the antenna 60. Thus, the positioning of the circuitry node 90 is dependent on the application of the antenna 60.

Figure 12:
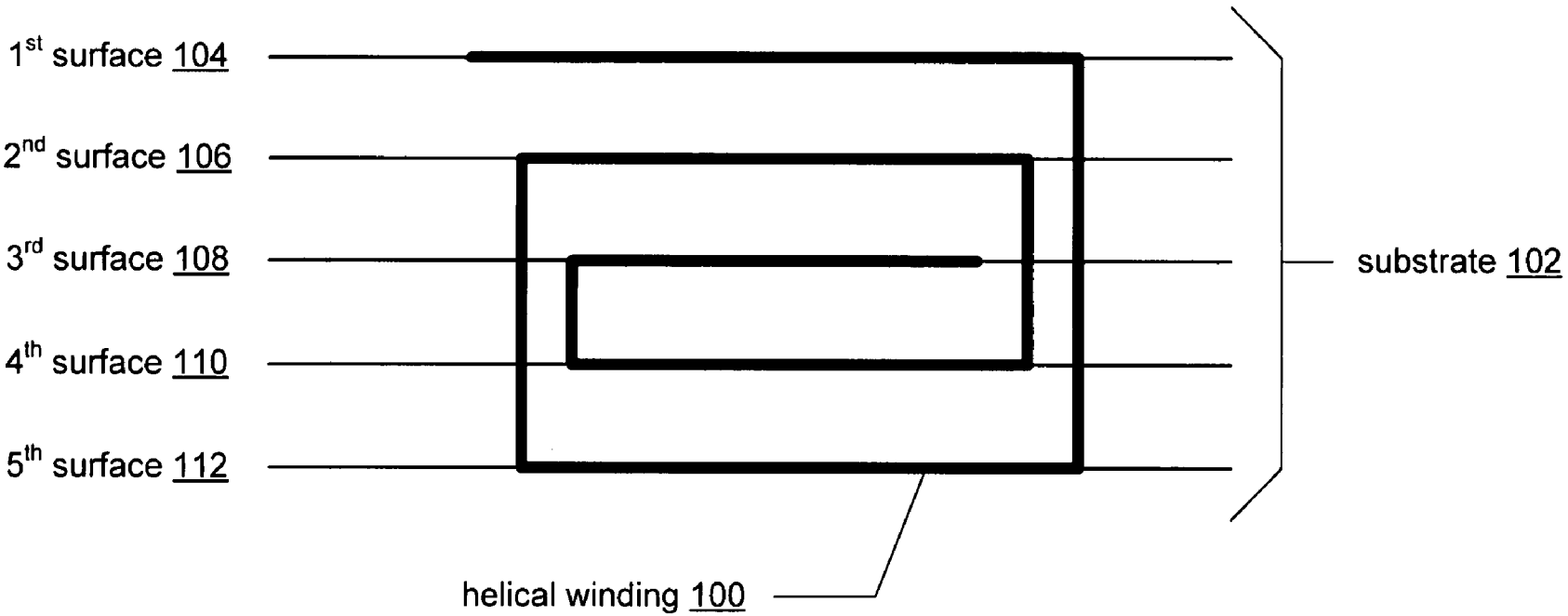
FIG. 12 is diagram of still another embodiment of an antenna in accordance with the present invention.

FIG. 12 is a diagram of an embodiment of an antenna 60 that includes a helical winding 100 on multiple surfaces 104-112 of a substrate 102. The substrate 102 may be a printed circuit board (PCB), an integrated circuit die, or other material that supports electronic circuitry that includes a plurality of layers and hence surfaces. In this example, the substrate 102 includes four layers and five surfaces 104-112. The helical winding 100 includes one or more traces on each surface 104-112 that are coupled by a plurality of interconnections (e.g., PCB vias or edge wrap-arounds).

As one of ordinary skill in the art will appreciate, the term "substantially" or "approximately", as may be used herein, provides an industry-accepted tolerance to its corresponding term and/or relativity between items. Such an industry-accepted tolerance ranges from less than one percent to twenty percent and corresponds to, but is not limited to, component values, integrated circuit process variations, temperature variations, rise and fall times, and/or thermal noise. Such relativity between items ranges from a difference of a few percent to magnitude differences. As one of ordinary skill in the art will further appreciate, the term "operably coupled", as may be used herein, includes direct coupling and indirect coupling via another component, element, circuit, or module where, for indirect coupling, the intervening component, element, circuit, or module does not modify the information of a signal but may adjust its current level, voltage level, and/or power level. As one of ordinary skill in the art will also appreciate, inferred coupling (i.e., where one element is coupled to another element by inference) includes direct and indirect coupling between two elements in the same manner as "operably coupled". As one of ordinary skill in the art will further appreciate, the term "operably associated with", as may be used herein, includes direct and/or indirect coupling of separate components and/or one component being embedded within another component. As one of ordinary skill in the art will still further appreciate, the term "compares favorably", as may be used herein, indicates that a comparison between two or more elements, items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

The preceding discussion has presented an antenna having a helical winding fabricated on a planer substrate. As one of ordinary skill in the art will appreciate, other embodiments may be derived from the teachings of the present invention without deviating from the scope of the claims.

What is claimed is:

1. An antenna comprises:

a substantially planer substrate having a first surface and a second surface; and a helical winding having a first pattern, a second pattern, and a plurality of interconnections, wherein the first pattern is affixed to the first surface and the second pattern is affixed to the second surface, wherein connection nodes of the first pattern are coupled to associated connection nodes of the second pattern by the plurality of interconnections, and wherein the first and second patterns include a tapered shape of substantially parallel conductors, wherein the tapered shape is dependent upon impedance matching of the antenna.

2. The antenna of claim 1 comprises:

the substantially planer substrate including a printed circuit board (PCB); and the plurality of interconnections including PCB vias.

3. The antenna of claim 2, wherein each of the first and second patterns comprises:

a plurality of traces, wherein each of the plurality of traces includes a trace width and spacing from an adjacent trace of the plurality of traces based on at least one of: PCB fabrication criteria and wavelength of a signal being transceived by the antenna.

4. The antenna of claim 1, wherein the helical winding comprises:

a length corresponding to a wavelength of signal, fraction of the wavelength, or a multiple of the wavelength.

5. The antenna of claim 1 comprises:

the helical winding provided a linear polarization for the antenna.

6. The antenna of claim 1, wherein the helical winding comprises:

a circuitry node operably coupled to a point on the first or second pattern; and a shorting pin coupled to the circuitry node and to a ground reference, wherein the shorting pin provides at least one of tuning frequency response of the antenna and adjusting impedance of antenna.

7. The antenna of claim 1 further comprises:

the substantially planer substrate including a multilayered substrate having a plurality of surfaces;

the helical winding including a plurality of patterns, wherein the plurality of patterns is affixed to the plurality of surfaces, wherein the plurality of patterns includes the first and second patterns and the plurality of surfaces includes the first and second surfaces.

8. A radio frequency identification (RFID) reader comprises:

an antenna operably coupled to receive an inbound radio frequency (RF) signal and to transmit an outbound RF signal;

a radio frequency (RF) front end operably coupled to convert the inbound RF signal into a inbound near baseband signal and to convert an outbound near baseband signal into the outbound RF signal;

a digitizing module operably coupled to convert the inbound near baseband signal into a digital inbound baseband signal;

pre-decoding module operably coupled to convert the digital inbound baseband signal into bi-phase encoded data; and a decoding module operably coupled to decode the phase encoded data to produce decoded inbound data;

an encoding module operably coupled to encode outbound data to produce encoded outbound data; and digital to analog converter operably coupled to convert the encoded outbound data into the outbound near baseband signal, wherein the antenna includes:

a substantially planer substrate having a first surface and a second surface; and a helical winding having a first pattern, a second pattern, and a plurality of interconnections, wherein the first pattern is affixed to the first surface and the second pattern is affixed to the second surface, wherein connection nodes of the first pattern are coupled to associated connection nodes of the second pattern by the plurality of interconnections, and wherein the first and second patterns include a tapered shape of substantially parallel conductors, wherein the tapered shape is dependent upon impedance matching of the antenna.

9. The RFID reader of claim 8, wherein the antenna comprises:

the substantially planer substrate including a printed circuit board (PCB); and the plurality of interconnections including PCB vias.

10. The REID reader of claim 9, wherein each of the first and second patterns comprises:

a plurality of traces, wherein each of the plurality of traces includes a trace width and spacing from an adjacent trace of the plurality of traces based on at least one of: PCB fabrication criteria and wavelength of the inbound or outbound RF signal being transceived by the antenna.

11. The RFID reader of claim 8, wherein the helical winding comprises:

a length corresponding to a wavelength of the inbound or outbound RF signal, fraction of the wavelength, or a multiple of the wavelength.

12. The RFID reader of claim 8, wherein the antenna comprises:

the helical winding provided a linear polarization for the antenna.

13. The RFID reader of claim 8, wherein the helical winding comprises:

a circuitry node operably coupled to a point on the first or second pattern; and a shorting pin coupled to the circuitry node and to a ground reference, wherein the shorting pin provides at least one of tuning frequency response of the antenna and adjusting impedance of antenna.

14. The REID reader of claim 8, wherein the antenna further comprises:

the substantially planer substrate including a multilayered substrate having a plurality of surfaces;

the helical winding including a plurality of patterns, wherein the plurality of patterns is affixed to the plurality of surfaces, wherein the plurality of patterns includes the first and second patterns and the plurality of surfaces includes the first and second surfaces.

* * * * *

UNITED STATES PATENT AND TRADEMARK OFFICE

CERTIFICATE OF CORRECTION

PATENT NO. : 7,557,772 B2
APPLICATION NO. : 11/386247
DATED : July 7, 2009
INVENTOR(S) : Franco De Flaviis and Seunghwan Yoon It is certified that error appears in the above-identified patent and that said Letters Patent is hereby corrected as shown below:

Column 8, line 44, in Claim 10: replace "REID" with --RFID--.

Column 9, line 1, in Claim 14: replace "REID" with --RFID--.

Signed and Sealed this

Twenty-ninth Day of September, 2009

David J. Kappos

David J. Kappos
*Director of the United States Patent and Trademark Office*